US005404078A

United States Patent [19]

Bunk et al.

[11] Patent Number: 5,404,078

[45] Date of Patent: Apr. 4, 1995

[54] HIGH-PRESSURE DISCHARGE LAMP AND METHOD OF MANUFACTURE

[75] Inventors: Axel Bunk, Berlin; Stefan Jüngst, Zorneding, both of Germany; Kouichiro Maekawa, Ichinomiya, Japan; Joachim Werner, Petershausen, Germany

[73] Assignees: Patent-Treuhand-Gesellschaft für elektrische Gluhlampen mbH, Munich, Germany; NGK Insulators Ltd., Nagoya, Japan

[21] Appl. No.: 912,526

[22] Filed: Jul. 13, 1992

[30] Foreign Application Priority Data

Aug. 20, 1991 [EP] European Pat. Off. ..... 91113912

[51] Int. Cl.[6] ..... H01J 17/18

[52] U.S. Cl. ..... 313/625; 313/623

[58] Field of Search ..... 313/623, 624, 625, 332, 313/636

[56] References Cited

U.S. PATENT DOCUMENTS

| | | | |
|---|---|---|---|
| 3,363,133 | 1/1968 | Harris . | |
| 3,885,184 | 5/1975 | Schat et al. | 313/332 X |
| 4,001,625 | 1/1977 | Schat et al. . | |
| 4,155,758 | 5/1979 | Evans et al. . | |
| 4,501,799 | 2/1985 | Driessen et al. | 313/636 X |
| 4,703,221 | 10/1987 | Ochoa et al. | 313/332 |
| 4,721,886 | 1/1988 | Oomen et al. | 313/623 |
| 4,780,646 | 10/1988 | Lange | 313/623 |
| 5,075,587 | 12/1991 | Pabst et al. . | |

FOREIGN PATENT DOCUMENTS

| | | |
|---|---|---|
| 0041296 | 12/1981 | European Pat. Off. . |
| 0087830 | 9/1983 | European Pat. Off. . |
| 0142202 | 5/1985 | European Pat. Off. . |
| 0150713 | 8/1985 | European Pat. Off. . |
| 0175502 | 3/1986 | European Pat. Off. . |
| 0341750A3 | 11/1989 | European Pat. Off. . |
| 2326034 | 4/1977 | France . |
| 61-093547 | 5/1986 | Japan . |

*Primary Examiner*—Sandra L. O'Shea
*Attorney, Agent, or Firm*—Frishauf, Holtz, Goodman & Woodward

[57] ABSTRACT

A high pressure discharge lamp has a ceramic discharge vessel (8), whose ends are closed with plugs (11). The metallic feedthrough, or a main part of it, has a thermal coefficient of expansion which is smaller than the coefficient of the ceramic. The current feedthrough is gas-tightly sintered directly into the plug.

29 Claims, 6 Drawing Sheets

HIGH-PRESSURE DISCHARGE LAMP AND METHOD OF MANUFACTURE

CROSS REFERENCE TO RELATED APPLICATION

U.S. application Ser. No. 07/912,347, filed Jul. 13, 1992 Eichelbrönner et al.

Reference to related patents, the disclosure of which is hereby incorporated by reference:

U.S. Pat. No. 4,545,799, Rhodes et al

U.S. Pat. No. 4,011,480, Jacobs et al

U.S. Pat. No. 4,160,930, Driessen et al

Reference to related patent: German Patent DE-PS 14 71 379

FIELD OF THE INVENTION

The present invention relates to a high-pressure discharge lamp, and more particularly to a high-pressure discharge lamp having a ceramic discharge vessel whose inner space contains an ionizable fill and which comprises two ends which are each closed by a ceramic member formed as a plug in which a metallic feedthrough of circular cross-section is located. It further relates to a method of making such a high-pressure discharge lamp. Such high-pressure discharge lamps may be high-pressure sodium discharge lamps, and, more specifically, metal halide lamps having improved color rendition. The use of a ceramic discharge vessel for the lamps enables the use of the higher temperatures required for such vessels. The lamps have typical power ratings of between 100 W–250 W. The ends of the tubular discharge vessel are closed by cylindrical ceramic end plugs comprising a metallic current feedthrough passing through the axial hole therein.

BACKGROUND

Customarily, these current feedthroughs are made of niobium (see German Patent Specification 14 71 379). However, they are only partly suitable for lamps that are intended for a long useful life. This is due to the strong corrosion of both the niobium tube and the ceramic material used for sealing the niobium tube into the plug when the lamp has a metal halide fill. An improvement is described in the U.S. Pat. No. 4,545,799, Rhodes et al. The niobium tube is tightly sealed into the plug by the shrinking process of the "green" ceramic during the final sintering without ceramic sealing material. This is readily possible because both materials have approximately the same coefficient of expansion ($8\times10^{-6}$ $K^{-1}$). Reference to the contents of this specification is expressly made.

Current feedthroughs made from other metals have also been tested. The U.S. Pat. No. 4,011,480, Jacobs et al, and 4,160,930, Driessen et al, describe discharge lamps in which tile tubular current feedthroughs consist of tungsten, molybdenum or rhenium. The tube is supported by a ceramic cylinder which has straight, axially aligned walls and is disposed in the interior of tile tubular current feedthrough. The cylinder may be either solid or hollow; in the latter case, the bore serves as the exhaust tube and is closed later. The seal between the feedthrough and tile ceramic parts engaging the feedthrough on the inside and on the outside thereof, which have been finally sintered at a temperature of 1850° C. prior to the finishing of the seal, is still made by using a ceramic sealing material. Although this improves the corrosion resistance of these lamps, it still does not satisfy the requirements as desired for metal halide fills. In spite of great efforts, it has not been possible heretofore to develop a ceramic sealing material that is capable of resisting corrosion.

THE INVENTION

It is an object of the invention to provide a feedthrough which is capable of resisting corrosion and changes of temperature and which can be used, more particularly, for lamps having a metal halide containing fill. Various methods will be described, showing how these lamps with the feedthroughs are made.

Briefly, the lamp has a ceramic discharge vessel, filled with an ionizable fill. The ends of the lamp are closed off by ceramic plugs, each formed with an opening through which a metallic current feedthrough of circular cross section extends. At least a main or first member of the current feedthrough is tubular and has a thermal coefficient of expansion which is smaller than the thermal coefficient of expansion of the ceramic. The current feedthrough is gas-tightly sintered into the plug without using a ceramic sealing material. The ceramic discharge vessel consists essentially of alumina and the non-conductive plug has alumina at least as a main component thereof. The direct sintering of the current feedthrough into the plug permits elimination of use of a ceramic sealing material which is subject to attack by the fill in the lamps so that the current feedthrough is gas-tightly sintered into the plug while being devoid of a sealing material.

In accordance with a feature of the invention, the vessel and the plug-shaped bodies are pre-fired, the feedthroughs are fitted into the axial hole of the pre-fired plug body, together with electrodes and connecting elements, and the subassembly is positioned in the axial hole of the pre-fired plug body. This subassembly with the plug body is positioned in the pre-fired open ends of the vessel body and the final assembly of feedthrough, plug body and vessel body are then sintered together in a hydrogen atmosphere, or vacuum, at a temperature of between about 1750° C. to about 1900° C. for about 3–5 hours, resulting in a vessel body having an optical translucency suitable for high-pressure discharge lamp use, and a gas-tight feedthrough assembly.

The following is to describe the way in which the present invention works.

Metals having a low thermal coefficient of expansion (molybdenum, tungsten and rhenium) are the metals which have a high corrosion resistance against agressive fills. Their use as a current feedthrough is, therefore, highly desirable. However, the problem of providing a gas-tight seal while using such feedthroughs has remained unsolved in the past.

Metals such as niobium and tantalum have thermal coefficients of expansion that match those of the ceramic; on the other )land, however, they are known for having poor corrosion resistance against agressive fills and they have not yet been available for use as a current feedthrough for metal halide lamps.

The present invention utilizes and combines the advantages of the two technologies, while eliminating their disadvantages.

At least the portion of the feedthrough which is exposed to the agressive fill in the interior of the discharge vessel is made of a corrosion resistant material having a low thermal coefficient of expansion, that is, a coefficient of expansion which is at least 20% lower than that of the ceramic vessel material.

A very simple and basic embodiment of the invention uses a continuous, tubular feedthrough of molybdenum which is tightly sintered directly into the ceramic plug without using any ceramic sealing material.

The feedthrough is bonded directly into the plug only by firing. This is very surprising insofar as it was hitherto believed that a durable direct sintering could only lie effected by using materials having approximately the same thermal coefficient of expansion as the ceramic, such as is the case with niobium.

It has become evident that a similar method can only be used with molybdenum, tungsten or rhenium (thermal coefficient of expansion $\leqq 6\times10^{-6}$ $K^{-1}$) if it is modified accordingly. This permits manufacture of a bond in which the materials lock together, free from cracks and fissures, and which can be used with less agressive fills and relatively low thermal strain.

It is advantageous that the tubular current feedthrough has very thin thickness, a small diameter, and a roughened surface. It is further advantageous that the relation between the inside diameter of the plug, facing the feedthrough, and the outside diameter of the feedthrough is within certain optimum dimensions. The seal made without any ceramic sealing material is obtained by first leaving the end plug as a green body into which the current feedthrough is introduced. In the final sintering of the plug which will now take place, the required reliable bond of the plug and current feedthrough interface will be achieved due to the shrinking process of the end plug in which the shrinking green body of the end plug is firmly forced onto the current feedthrough.

An important parameter of the present invention is that the current feedthrough is not a solid cylinder but a tube having a sufficiently thin wall in order to be able to deform slightly to compensate for the force acting on the feedthrough caused by the shrinking of the end plug during the final sintering. On the other hand, the current feedthrough tube must be sufficiently thick in order to be able to ensure mechanical stability and, more particularly, to be able to securely retain the shaft of an electrode. A wall thickness of 0.1 to 0.25 mm has proved especially suitable.

A second important parameter is the diameter of the current feedthrough which determines the absolute value of the thermal expansion. The smaller the diameter is in actual fact, the smaller are the forces of expansion occurring during operation of the lamp. Preferably, the outer diameter is smaller than 2.0 mm On the other hand, for most practical purposes, and to be able to carry enough current, a minimum inner diameter of 0.5 mm is recommended, although a smaller diameter may be used for certain low-wattage lamps.

A third important parameter is the surface roughness of the feedthrough. The direct sealing between the feedthrough and the plug appears to be due mainly to a mechanical bond and, to a lesser degree, to a diffusion bond. The larger the contacting areas at the interface of feedthrough and plug, the more effectively can be attained the gas-tightness of the direct sealing portion. Preferably, the surface roughness of the feedthrough is about 10–50 μm by Ra, which means a center-line average surface roughness.

A roughness of less than 10 μm is not effective to the improvement of gas-tightness. A roughness larger than 50 μm, although suitable for producing a discharge vessel body with good gas-tightness, is not preferable because it decreases the reliability and mechanical stability of the current feedthrough. This roughening can be simply done by means of various ways such as sand blasting, chemical etching and machining.

A fourth important parameter is the selection of the optimum relation between the inside diameter of the end plug and the outside diameter of the current feedthrough. Prior to sintering, the end plug is in an unsintered or so-called "green" state. Upon sintering, the end plug shrinks, with both its outside and inside diameter decreasing. If the decrease of the plug's inside diameter during shrinking is much too high, cracking of the end plug is caused due to the counter stress from the current feedthrough introduced into the plug's inside hole. If the decrease in diameter is too low, the counter force at the interface between the end plug and current feedthrough becomes weak and results in the lack of gas-tightness of the discharge vessel. Preferably, the inside diameter of the end plug—if sintered without introducing the current feedthrough—should be 5 to 10% less than the normal, undeformed outside diameter of the current feedthrough.

In carrying out this technological process, the seal is obtained by first positioning the current feedthrough into the axial hole of the plug while the plug is in the green state. One of the assemblies thus obtained is inserted in each end of the tubular vessel in the green state, and the said inserted assembly is sintered in hydrogen or in a vacuum atmosphere at a temperature of about 1850° C. for 3 hours. The required reliable seal at the plug-feedthrough interface is achieved due to the shrinking process of the plug in the green state during sintering in which the shrunk end plug body finally is firmly bonded onto the current feedthrough.

When tubes are used as a feedthrough which are made exclusively of molybdenum, and when the discharge vessels are subjected to very great strain, for example, in the case of lamps having excellent color rendition, in which the temperature of its coldest spot is higher than 700° C., a gap may form between the current feedthrough and the plug after about 500 temperature cycles (or changes of temperature subsequent to the switching on and off of the lamp). The width of such a gap is about 3 μm. This gap occurs as a result of the large difference between the low thermal coefficient of expansion ($6\times10^{-6}$ $K^{-1}$) of the molybdenum and the high coefficient of expansion of the ceramic ($8\times10^{-6}$ $K^{-1}$) which has an effect caused by the strain from the temperature changes and it may result in lamp failure.

This basic technology is modified such that it can be used for high sodium discharge lamps and metal halide lamps having improved color rendition and is markedly superior to prior art technology.

A first technical modification is to use a modified plug which consists of a composite material having a coefficient of thermal expansion between those of the ceramic vessel material and of the tubular metallic feedthrough material. The tubular feedthrough, e.g. of molybdenum, is gas-tightly sintered directly into the plug of composite material, which comprises, for example, alumina and tungsten, without using any ceramic sealing material. This body fired as a unit maintains gas-tightness after more than 500 heat cycles between 20° C. and 900° C. It is possible to apply a hydrogen atmosphere for firing together of an assembled body which consists of a metallic feedthrough, a plug of composite material and the ceramic discharge vessel.

A first important parameter of this technology is to use a tubular feedthrough of molybdenum, tungsten, rhenium or alloys thereof. If the feedthrough were a solid, for example, a rod or wire, cracking would occur at the direct-bonded portion. It is preferable to use a tube of small outside diameter. Preferably, the outer diameter is smaller than 2.0 mm. The thickness of the tube is not essentially limited, however, to prevent cracking under the shrinking force caused under the firing process. The inside diameter of the tube should be at least more than 0.3 mm.

A second important parameter is the plug material. It must have a coefficient of thermal expansion between those of a metallic current feedthrough and the ceramic discharge vessel and a good corrosion resistance against any agressive fill component such as metal halides and sodium. Furthermore, it is desirable to select such a material which permits firing it is an assembled body together as a unit in a hydrogen atmosphere. The assembled body consists of a metallic feedthrough, a ceramic vessel and a plug formed by such a composite material.

The plug material consists of two components. Alumina is the main and indispensable first component. The second component comprises one or more materials selected from the metals tungsten, molybdenum and rhenium, or graphite or ceramics having a low coefficient of thermal expansion such as AlN, TiC, $Si_{34}$, SiC, ZrC, $TiB_2$, and $ZrB_2$. The ratio of the two components is the following: the proportion of the main component alumina is 60 to 90% by weight, and the proportion or the second component is 10 to 40% by weight. The respective coefficients of thermal expansion of these composite materials are about 5.5 to $6.5\times10^{-6}K^{-1}$. The reason why alumina has to be an indispensable component is not only its excellent corrosion resistance, but also due to a solid diffusional reaction under firing at a temperature of about 1800° C., the seam originally located at the contacting zone between the plug and the end of the discharge vessel is eliminated and thus a quasi unitary structure is formed. The proportion of alumina should be at least 60% by weight. If this proportion is higher than 90% by weight, the composite material does not have a desirable coefficient of thermal expansion, and, as a result, the direct-bonded portion between the plug and the metallic feedthrough is unable to maintain the gas-tightness after numbers of heat cycles, which finally results in lamp failure. If the proportion of the second component, especially due to the metal included therein, is too high, it is very difficult to sinter the plug and to make a highly densified dispersion of composite material which is needed to guarantee the gas-tightness of the plug itself. For example, in case of a composite material consisting only of alumina and tungsten (or one or more of the above mentioned metals), a ratio of alumina: tungsten =70 to 83: 30 to 17 by weight shows the best results with respect to gas-tightness. For other second component materials, the most favorable proportion is within 10 to 25% by weight. This applies especially to the ceramic materials or blends of ceramic and metallic materials. A preferred example is a plug with 20% SiC, balance $Al_2O_3$.

These composite materials can be manufactured nearly without hardly any special conditions. Basically the procedure is the following: weighing the desired proportion of alumina powder and of the second component; adding some auxiliary pressing agents for forming, such as water, alcohol, organic binder etc.; mixing them by a ball-mill or kneader; making a granular powder suitable for the fabrication process by means of a spray-dryer and/or in any other way, and finally shaping a plug provided with an axial hole for positioning a current feedthrough therein. One special condition must be kept in mind: apart from alumina and SiC, the materials for the second component oxidize and decompose comparatively easily. Therefore, it is necessary to carefully select both the suitable auxiliary agents for forming and optimum conditions such as atmosphere and temperature at the pre-firing process, which removes the auxiliary agents which have been introduced for forming the green body to a plug shape, and to prevent oxidation and/or decomposition of the second component materials. Otherwise the result would be an undesired coefficient of thermal expansion and/or the occurrence of cracking in the plug body itself.

A third important parameter is the surface roughness of the metallic feedthrough. It is desirable to use a metallic feedthrough having a roughened surface, but this is not as important as the other parameters because it is possible to maintain gas-tightness at the direct-bonded region between plug and feedthrough, even if the feedthrough is not specially prepared.

A fourth important parameter is the optimum relation between the feedthrough and the plug on the one hand and between the plug and the ceramic vessel on the other hand. The conditions which make a ceramic discharge vessel have a direct-bonded closure, obtained by firing the elements assembled as a unit, which may also be termed "co-firing", at one or both of its ends are almost the same as in the basic technology. The axial hole diameter of the plug where a metallic current feedthrough is positioned passing through the hole and being directly bonded to it by co-firing has to be adjusted so that after shrinking it would be 3 to 10% less than the original ,outer diameter of a metallic feedthrough, if the plug were fired without a metallic feedthrough. A similar condition applies to the inner diameter of the end portion of the ceramic discharge vessel, in which end portion the plug is inserted and a single-bodied structure is created by applying a solid diffusional reaction under co-firing. This inner diameter has to be adjusted so that after shrinking it would be within a range of 2 to 5% less than the outside diameter of the plug if only the vessel were fired. The reason for those conditions is the same as that of the basic technology.

A second technical feature which modifies the basic technology is that the feedthrough is composed of two members. The first or main member is located at least at the side of the plug facing the discharge space.

In one embodiment it is possible that this first member extends to the opposite side of the plug. In another embodiment, the first member ends at about in the middle of the plug. It consists of molybdenum, tungsten or rhenium or an alloy of these metals. Contrary to the above mentioned integral feedthrough, the first member may be formed from a tube or a solid cylinder (rod).

The second or auxiliary member can also be a tube or a cylinder of solid material. The tube may be a collar for the first member or a prolongation of the first member. It consists of a material whose thermal coefficient of expansion is matched approximately to that of the ceramic material of the plug. Preferably, niobium is used for the second member; however, it is equally possible to use tantalum. If a tube is used, its wall thickness again can be selected between 0.1 and 0.25 mm.

The first and second member of the current feedthrough are connected by laser welding or electron beam welding. In order to obtain a seal of lasting tightness, the second member is so affixed to the first member that its distance from the inner space of the discharge vessel is as large as possible. Preferably, the second member is affixed to the first member such that its distance from the inner space of the discharge vessel is at least 40% of the height of the ceramic plug. This ensures that the agressive fill components will reach the niobium auxiliary member, which is not corrosion resistant but permits a durable seal, only subsequent to the decreasing tightness of the seal in the region of the molybdenum main member (that is, after a long delay).

The second or auxiliary member has preferably a height of at least 30% of the height of the plug. This provides for a long path with a reliable seal.

A first possibility for realizing this composite conception is to butt-weld a second tube member to that end of a first tube member which is remote from the discharge and has approximately the same diameter and the same wall thickness. On the side facing the discharge, the second tube can be either open, or, in a particularly preferred embodiment, it can be closed. When the tube member is open, the greatest care has to be taken in the butt-welding to obtain a gas-tight connection between the two tube members, since, otherwise, a leak might occur along the outer wall of the first member, the weld seam and, finally, the inner region of the second member. The safety of the seal at the outer wall of the second tube member would not play a role. If the second tube member is closed, the weld seam is relieved from this critical duty. A leak in the weld seam no longer leads to a lack in tightness of the entire system, and the safe seal in the region of the outer wall of the second tube member remains the critical location.

This first embodiment of a composite current feedthrough can be manufactured simply and safely. It is particularly suitable, above all, for current feedthroughs of relatively large inner diameter (1.5–1.8 mm).

However, particular care must be exerted in the manufacture of a connection with an external current supply lead (customarily of steel, niobium or nickel), since the material of the second tube member, preferably niobium, becomes brittle during the sintering process, especially so when it is exposed to hydrogen as a main component of the sintering atmosphere; therefore vacuum can best be used as sintering atmosphere for the two member-technology, although contact with hydrogen is highly desirable (see below).

In a second embodiment, the second tube member closely surrounds only a portion of the first member remote from the discharge in the form of a collar, preferably having about half the height of the plug length. The said collar surrounds a continuous first tube member which is similar to the basic embodiment. The collar can either be flush with the end surface of the plug, or, it can lie completely within the plug. Particularly satisfactory results with a view to lamp life are also obtained by this method when the above dimensions of distance and tube height are taken into consideration. The collar is welded to the main member gas-tightly at the collar end facing the discharge, whereby both members are sealed into the ceramic plug by the same co-sintering or co-firing way as that of the ceramic vessel and the plug, which is known from prior art.

This modification has the advantage that the external current supply lead can be easily joined to the first tubular member of the current feedthrough which projects beyond the portion surrounded by the collar. It is particularly suitable for current feedthroughs having a small inner diameter (1.0–1.5 mm), whereby the inner diameter of the collar is approximately 1.2–2.0 mm.

The manufacture of the seal is relatively complex, since the ceramic plug must have a specific recess for the collar.

The current feedthrough and the collar are connected in gas-tight manner by an annular weld seam in the region of the end of the collar facing the discharge.

A third embodiment uses a solid material second member in combination with a solid material or tube formed main member. The second member is again the prolongation of the first member. The diameter of the first member is preferably chosen bigger than that of the second member. In that way, the gas-tightness of the feedthrough is improved.

It has become evident that for those composite embodiments a similar method can be used with combinations of tungsten, rhenium or their alloys instead of molybdenum and of tantalum instead of niobium if it is modified accordingly. The discharge vessel provided with the current feedthrough structure permits manufacture of a bond in which the materials lock together, free from cracks and gaps, and which can be used with less agressive fills and relatively high thermal strain. Particularly satisfactory results with a view to lamp life are also obtained by this method.

In the case of the composite embodiments, the first member permits a tightness lasting but a relatively short time. The gas-tightness of the discharge vessel is basically attained at the portion of the interface between the second member and the axial hole of the ceramic plug due to the shrinking process of the plug in which the shrinking green body of the plug is firmly forced onto the second member (rod or tube) during final sintering. It is preferable in case of a tubular first member to press such force also onto the portion of the first member contacting with the plug to make its interface without any gap in order to prevent penetration of the metal halide component.

However, it has to be kept in mind that a small gap might form anyhow in the interface of plug and first member after repetition of the switching on and off of the lamp. Surprisingly, advantage can be taken of this feature, if the force pressed onto this first member by shrinking of a green state plug during sintering is chosen consciously lower than that onto a niobium part. Although the gap is formed earlier, the lamp lifetime still remains markedly prolonged. This is attained due to the important feature that the diameter of the first member is chosen bigger than that of the second member.

Thus, this technique is applicable to first members, formed either as rods or as tubes. This permits selection of various modifications in designing of current feedthrough structures. For example, in case of one end of the discharge vessel which does not serve as an exhaust, or a filling inlet, it is possible to use a solid current feedthrough comprising the first and the second member of the feedthrough formed as a rod, welded together, instead of a tubular one.

For realizing the composite embodiments, there are important parameters as follows:

The first parameter is that, especially in case using tubular feedthrough parts, they have to be connected in gas-tight manner by an annular weld seam in the region of the collar facing the discharge portion, since, otherwise, a leak might occur along the outer wall of the molybdenum feedthrough, the weld seam and, finally, the inner region of the niobium collar. The safety of the seal at the outer wall of the niobium collar does not play a role.

The second parameter is the diameter of, especially, the first member which determines the absolute value of the thermal expansion. The smaller the diameter is in actual fact, the smaller are the forces of expansion occurring during operation of the lamp. Preferably, the outer diameter is smaller than 2.0 mm. This applies to both a rod and a tube configuration.

The third parameter is the surface roughness of the feedthrough which contacts with the axial hole of ceramic plug. The direct sealing between the feedthrough and the plug appears to be due mainly to a mechanical bond and, to a lesser degree to a diffusion bond. The larger the contacting areas at the interface of both parts, the more effectively can be attained the gas-tightness of the direct sealing portion. Preferably, the surface roughness of both feedthrough members is about 10 to 50 μm in case of the tubular feedthroughs, and about 10 to 100 μm by Ra for the rod or solid feedthroughs. A roughness of less than 10 μm is not effective to the improvement of gas-tightness.

A roughness larger than 50 μm on the tubular feedthroughs is not preferable because it decreases the reliability and mechanical stability of the current feedthrough. Further, a roughness larger than 100 μm on the solid feedthrough is no problem with respect to mechanical stability, however, it may form a rather non-contacted area on the interface of the feedthrough and the plug in order to be beyond the capability of the plug's deforming and shrinking against the feedthrough, and result in a lack of gas-tightness.

The fourth parameter is the selection of the optimum relations between the axial hole diameter of the alumina plug and the outside diameter of the current feedthrough. Prior to sintering, the plug is in an unsintered or so-called "green" state. Upon sintering, the green body shrinks, with both its outside and inside diameter decreasing. If the decrease of the plug's axial hole diameter during shrinking is much too high, cracking of the plug is caused due to the bounding stress from the current feedthrough introduced into the axial hole of the plug. If it is too small, the bonding force at the interface between the plug and the feedthrough becomes weak and it results in the lack of gas-tightness of the discharge vessel.

In the case of a current feedthrough first member made from a tube, it is preferable though not necessary that the related part of the axial hole diameter of the alumina plug, if sintered without introducing the feedthrough, would be about 5 to 10% smaller than the outside diameter of the first member.

However, for the feedthrough first members comprising a rod of solid material it is necessary to reduce the hole diameter of the plug such that its dimension is only about 1 to 3% smaller (in the above mentioned sense) than the outside diameter of the molybdenum part. This is due to the fact that the solid molybdenum is not able to deform itself during shrinkage, and therefore, this could result in the cracking of the alumina body itself due to the strong bounding force if the shrinkage is too high. On the contrary, the tubular molybdenum is capable of deforming slightly itself to compensate the pressing force caused from the high difference of the thermal shrinkage (as discussed above) between alumina body and molybdenum feedthrough during cooling after the sintering. However the rod technique can be applied to a tubular first member too, if desired.

In both cases, the part of the hole of the plug related to the second member of the feedthrough has to be selected such that the hole part, if sintered without the feedthrough, would possess a diameter which is about 5–10% smaller than the outside diameter of the second member. This is irrespective of the tube or rod shape of the second member because its thermal coefficient of expansion is similar to that of the plug.

The fifth parameter is the selection of sintering atmospheres. Niobium metal, which is one preferred part of the composite current feedthrough, becomes significantly hard and brittle under a hydrogen atmosphere of a temperature higher than 1700° C. known in the prior art relating to the manufacture of optically translucent alumina ceramics, and this results in the cracking of the alumina body due to the bounding stress of niobium hardened during sintering in hydrogen.

However, it has been found that it forms a slight, thin second layer at the interface between alumina and niobium and the portion having this second layer will be perfectly gas-tight. Cracking does not occur.

It was an extremely difficult task to find a way to provide the niobium with hydrogen in such a quantity, that perfect bonding is obtained without making the niobium brittle. This problem is solved by introducing an additional presintering step.

From this fact, prior to final sintering, a current feedthrough is positioned into the axial hole of the green plug body and presintered in an atmosphere of 5–30% by volume hydrogen, the balance being argon and/or nitrogen, at a temperature of about 1250° C. to 1500° C. until both plug and feedthrough are partially connected. A higher volume of hydrogen than the above and higher temperature than 1500° C. would make a niobium part harden too much, and the less volume of hydrogen than 5% by volume and lower temperature than 1250° C. are not effective to the formation of the second layer. Tile final sintering has to be carried out in vacuum to prevent the hardening of the niobium part after inserting the pre-sintered assembly into each end of the green discharge vessel body. This method differs somewhat from the method applied to a pure molybdenum feedthrough because the niobium member is rather sensitive.

The present invention provides a high-pressure discharge lamp of long life whose tightness is not impaired by the use of halide containing fillings. The discharge vessel is customarily tubular, either cylindrical or barrel-shaped. There is a direct bonding between the plug, which may be formed cylindrical or as a top-hat, and the discharge vessel. This bonding is carried out as known in the prior art. Frequently, the discharge vessel is arranged in an outer bulb which may be single-ended or double-ended.

DRAWINGS

DETAILED DESCRIPTION

Figure 1:
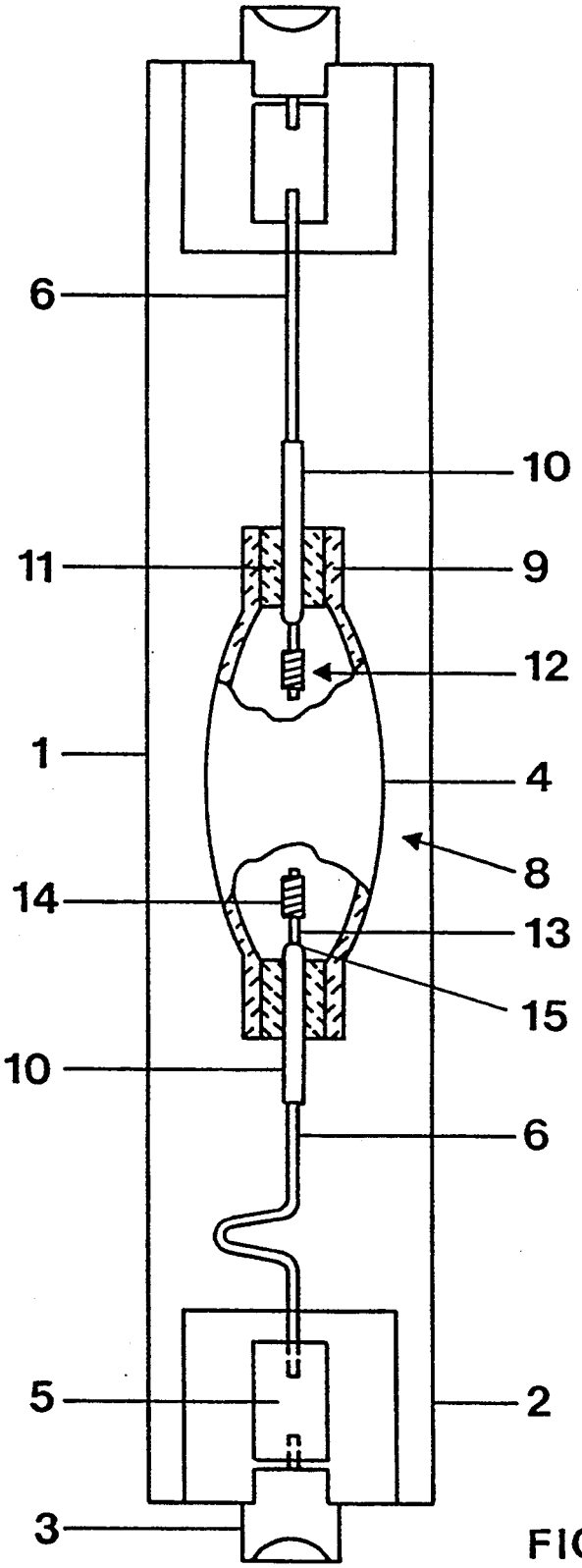
FIG. 1 shows a metal halide lamp having a ceramic discharge vessel.

FIG. 1 shows, schematically, a metal halide discharge lamp having a power rating of 150 W. It includes a cylindrical outer envelope 1 of quartz glass or hard glass defining a lamp axis. The outer envelope has pinch seals 2 on both sides, and bases 3. The axially aligned discharge vessel 8, of alumina ceramic, has a barrel-shaped middle portion 4 and cylindrical ends 9. It is supported in the outer envelope 1 by two current supply leads 6 which are connected via foils 5 to the bases 3. The current supply leads 6 are welded to tubular current feedthroughs 10 which are fitted in the respective plugs 11 of alumina ceramic at the end of the discharge vessel. The plug 11 is connected to the end 9 in well-known manner.

The two integral current feedthroughs 10 of molybdenum (or of tungsten or of a tungsten/rhenium alloy, if desired) each support an electrode system 12 on the side facing the discharge. The electrode system consists of an electrode shaft 13 and a coil 14 slipped onto the end of the electrode shaft on the side facing the discharge. The shaft of the electrode is gas-tightly tightly connected by a weld with the end 15 of the current feedthrough which is closed on this side. The electrode system can also be of the type that has a ball-shaped end instead of carrying a coil.

The filling of the discharge vessel comprises, in an inert starting gas such as, for example, argon, and further mercury and additives of metal halides. In another example, the mercury component can be omitted.

Figure 2:
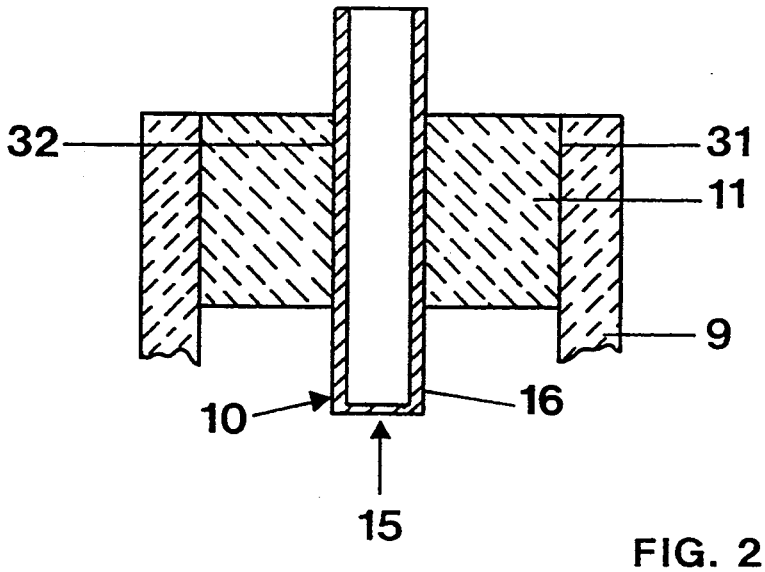
FIGS. 2–9 show in detail several practical examples of the seal region of the discharge vessel in section.

FIG. 2 shows, highly schematically, a basic example of the seal region at one end of the discharge vessel 8 in detail. The discharge vessel has at its cylindrical ends 9 a wall thickness of 1.2 mm. A cylindrical plug 11 of alumina ceramic is inserted into the end 9 of the discharge vessel. Its outer diameter is 3.3 mm, its height 5 mm. An integral feedthrough, made from a molybdenum tube 10, which is closed on the side 15 facing the discharge, is directly sintered into an axial opening in the plug. The molybdenum tube 16 forming the feedthrough 10 has a length of 12 mm; a wall thickness of 0.2 mm and an inner diameter of 1.0 mm. The tube 10 projects on both sides approximately equally far beyond the plug 11. The closure 15 can be either present on the tube 16 itself, with the electrode shaft welded thereto, or can be obtained by gas-tightly inserting an electrode shaft in the tube end in known manner.

The direct sintering of the integral current feedthrough into the plug is carried out as follows: The present process for producing a discharge vessel 8 with cylindrical ends 9, provided with a plug 11 and an integral current feedthrough 10 which is directly sealed into the axial hole of the plug, comprises preparing a current feedthrough provided with an electrode system 12, said feedthrough being made from a molybdenum tube of which the inside diameter and thickness are 1.0 mm and 0.2 mm respectively. Further, the process comprises providing two kinds of mixtures of inorganic powders as a starting material, so-called dispersions, composed of alumina and doping material such as $Y_2O_3$ and/or MgO. One of said dispersions is applied to the vessel body. The alumina used for this dispersion has a specific surface area ranging from about 5 $m^2/g$ to about 10 $m^2/g$. The other dispersion is applied to the plug body; the alumina used for this dispersion has a specific surface area ranging from about 3 $m^2/g$ to about 5 $m^2/g$. Said dispersions are formed into two kinds of green bodies (vessel- and plug-shaped). The difference in linear shrinkage ($\Delta L/Lo(\%)$), which is the difference in length between the green body and the sintered body, $\Delta L$, divided by the length of the green body, Lo, between said two green bodies is preferably about 3 to 5%. For example, said vessel-shaped green body has a linear shrinkage of 21 to 24% and said plug-shaped green body has a linear shrinkage of 17 to 20%. The bonding portion 9 of the vessel-shaped body has an inside diameter of 4.00 mm and the plug-shaped green body has an outside diameter of 3.96 mm, a height of 6.0 mm and an axial hole diameter of 1.56 mm. The process further comprises prefiring or presintering the said bodies in an air atmosphere at a temperature ranging from about 1000° C. to about 1400° C. to eliminate impurities including shaping aids and water, positioning the current feedthrough 10 into the axial hole of said prefired plug body, inserting said positioned body into a bonding portion 9 in each end of said prefired vessel body, and sintering said assembled body in an atmosphere of hydrogen or in vacuum at a temperature ranging from about 1750° C. to about 1900° C. for 3 to 5 hours. A sintered discharge vessel body and directly sealed current feedthrough, is produced. The discharge portion of the body has an optical translucency which light or radiation in the visible wavelength is able to pass through sufficiently. The inside diameter of the bonding portion of the vessel body shrinking more than the outside diameter of the plug body. Also the axial hole diameter of the plug body shrinks more than the outside diameter of the current feedthrough. The bonding portion of the vessel and direct sealing portion of the plug slightly deform about the plug and the current feedthrough as is known in the prior art, and resulting in said sintered body having a perfect gas-tightness at the interfaces of the vessel to plug bonding portion 31 and at the plug to-current feedthrough direct sealing portion 32.

In a preferred embodiment, the example of FIG. 2 is slightly modified in that a cylindrical plug 11 of composite material is used, consisting of alumina and tungsten of respectively 80% and 20% by weight. The dimensions are the same as already discussed in connection with FIG. 2. The manufacturing process is essentially the same as discussed above with the following exceptions. The dispersion suitable for the plug body is composed of alumina and tungsten, the alumina having a specific surface area of about 3 to 5 $m^2/g$ and the tungsten having an average particle size of less than one micron, the weight ratio of said alumina/tungsten being 80/20. It has to be pointed out that such a composite body cannot be considered as a cermet because it does not have the typically small resistance of a cermet, for example 20 mΩ. On the contrary, the resistance of the composite body is advantageously very high (typically, $10^{10}\Omega$), so that the composite body is nonconducting and hence undesired back-arcing after ignition is avoided. Again, the two dispersions are Formed into two kinds of green bodies (vessel- and plug-shaped). The difference in linear shrinkage and the dimensions also can be the same as discussed above. In contrast to the basic example, only the vessel-shaped hotly is prefired in air atmosphere at a temperature of about 1,000° C. to 1,400° C. to eliminate impurities including shaping aids and water. On the other hand, said plug-shaped body is prefired in air atmosphere at a temperature of less than 300° C. to prevent the oxidation of the tungsten component and to remove shaping aids and water prior to the real presintering in a hydrogen atmosphere at a temperature of 1,200° C. to 1400° C. By this presintering, the axial hole diameter of the plug-shaped body shrinks to about 1.45 mm.

The process further comprises, as already discussed, positioning the current feedthrough 10 in the axial hole of the said presintered plug body, inserting the said positioned body into a bonding portion in each end of the prefired vessel body, and sintering the assembled body in an atmosphere of hydrogen or in vacuum at a temperature of about 1750° C. to 1900° C. for 3 to 5 hours. The resulting gas-tightness of the bonding portion 31 and sealing portion 32 is especially good.

Figure 3A:
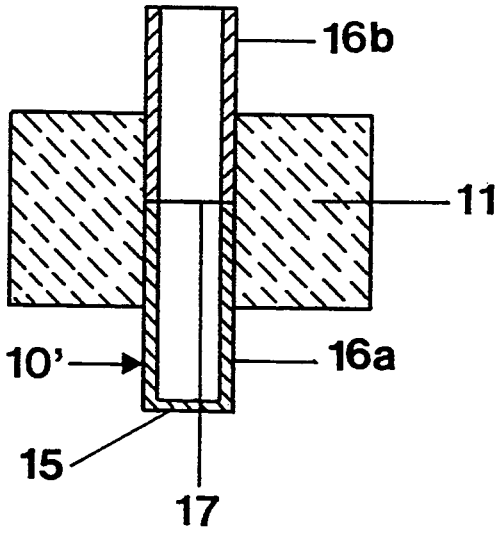

The following examples are concerned with composite feedthroughs. FIG. 3*a* illustrates a first example. The first member 16*a* of the current feedthrough 10', made of a molybdenum tube, has only half the height of the basic example of FIG. 2 and terminates at about half the height of the plug 11. It faces the discharge and carries the electrode shaft at the closure 15.

Figure 3B:
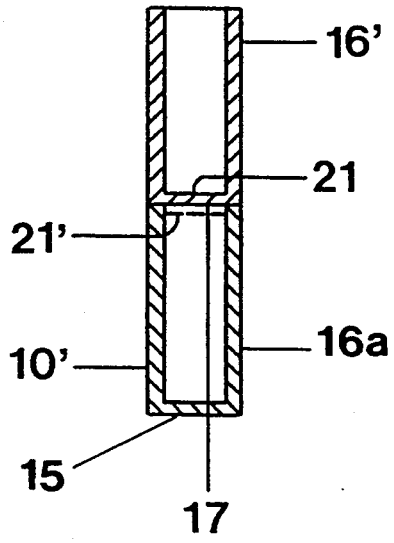

At the side facing away from the inner space of the discharge vessel, there extends a second member 16*b*, made of a niobium tube, which is butt-welded to the first member 16*a* at the seam 17. Both parts have approximately the same dimensions, that is, an inner diameter of 1.5 mm and a wall thickness of 0.1 mm. The second member 16 projects beyond the plug 11 on the side facing away from the discharge. In a particularly preferred example (FIG. 3*b*), the second member 16' is closed by a cup 21 at the seam with the first member 16*a*. Here, the butt-welding has been carried out in the region of the seam 17. For the rest, the same reference numbers designate the same parts. In addition, the molybdenum first member 16*a* can be closed at this end (shown by reference number 21' and a broken line in FIG. 3*b*).

Figure 4:
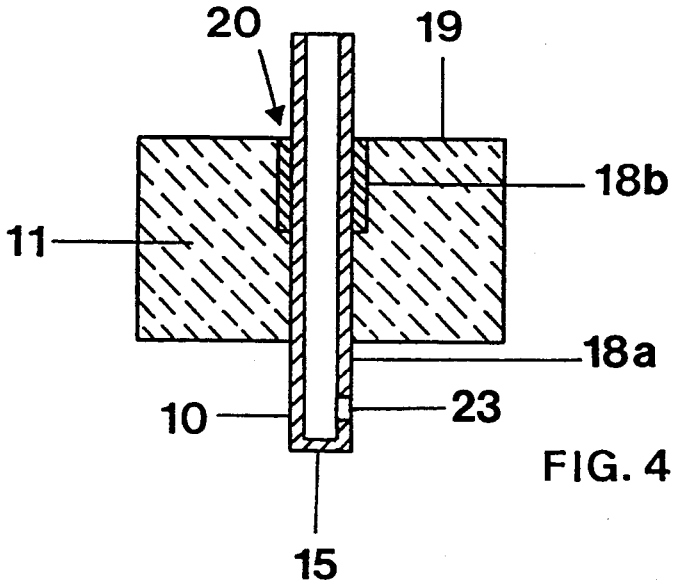

In a further practical example (FIG. 4), the tubular first member 18*a* of the feedthrough 10, made from molybdenum is disposed continuously in the plug 11 and has a closure 15 as in the basic example. In the half of the plug 11 facing away from the discharge, however, a niobium tubular second member 18*b* surrounds, as a collar, a portion of the first member 18*a* and is flush with the end surface 19 of the plug. The plug has a cylindrical recess 20 which is matched to the collar. The first member 18*a* has an inner diameter of 1.0 mm and n wall thickness of 0.2 mm, whereas the collar 18*b* has an inner diameter of 1.4 mm and a wall thickness of 0.25 mm. The height of the collar is 2.4 mm. The plug 11 has 4 mm in outside diameter and 5 mm in height.

In this example, the first of the two current feedthroughs, positioned at both ends of the discharge vessel, is gas-tightly closed on the side facing the discharge, whereas the second feedthrough has a small bore 23 (illustrated in broken lines) in the neighbourhood of closure 15 which serves as an exhaust and filling inlet. This bore 23 is closed after the filling of the metal halide components in a known manner, for example by laser heating of a ceramic or metallic sealing material.

These two different kinds of plugs with gas-tightly welded composite current feedthroughs positioned in the axial hole of the plugs are inserted respectively into the ends 9 of the alumina discharge vessel. The plugs and the vessel are still in the green state. They are co-fired or co-sintered to produce a direct seal.

It is only after the said sintering process that the filling is introduced into the discharge vessel and the bore 23 is closed.

Figure 5:
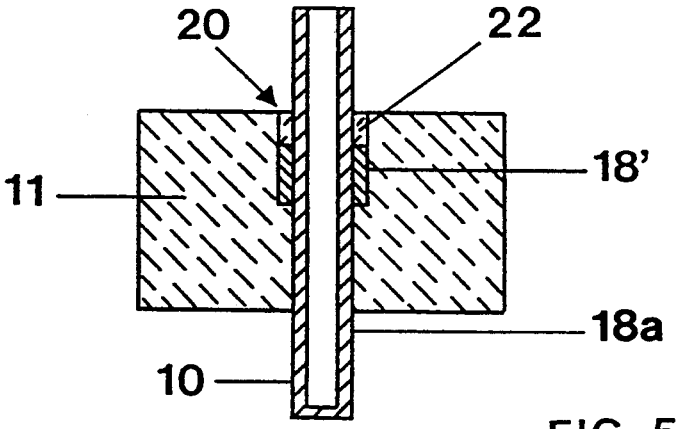

This example can be so modified (FIG. 5) that the collar 18' is disposed completely within the plug 11, which ensures a particularly good seat, and the embrittlement of the niobium collar, which might interfere with the tightness due to the sintering at high temperature such as 1850° C. is reliably prevented. It has proved particularly desirable to realize this by making the depth of the cylindrical recess 20 greater than the height of the collar 18' disposed therein, and by covering the remaining hollow space at the end of the plug remote from the discharge by a suitable ring 22 of ceramic material. The ring 22 can preferably be applied as a green body on the first member 18*a* which is then finally sintered together with the green body of the plug 11 and thus sealingly engages the first member 18*a*. More specifically, the ceramic material of the ring 22 can be so selected that its thermal coefficient of expanse on is somewhat smaller than that of the plug 11, however, markedly higher than that of the first member 18*a*. This can be achieved for example by providing a suitable doping (e.g., $SiO_2$) of the plug material in contrast to the ring material.

Figure 7:
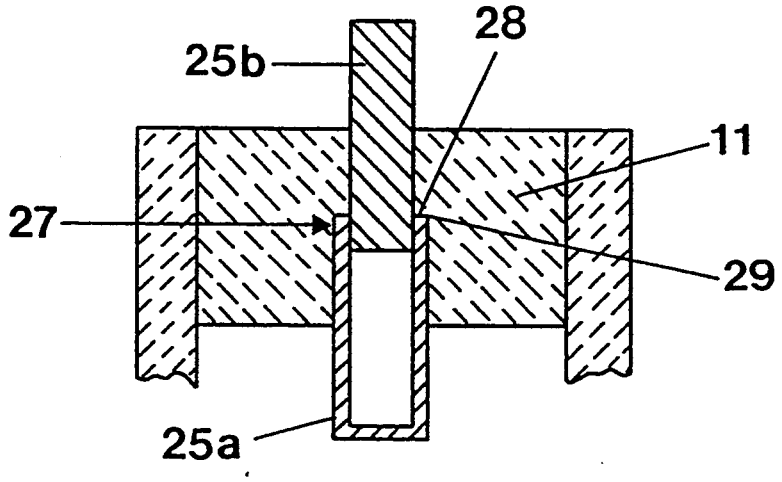
Figure 6:
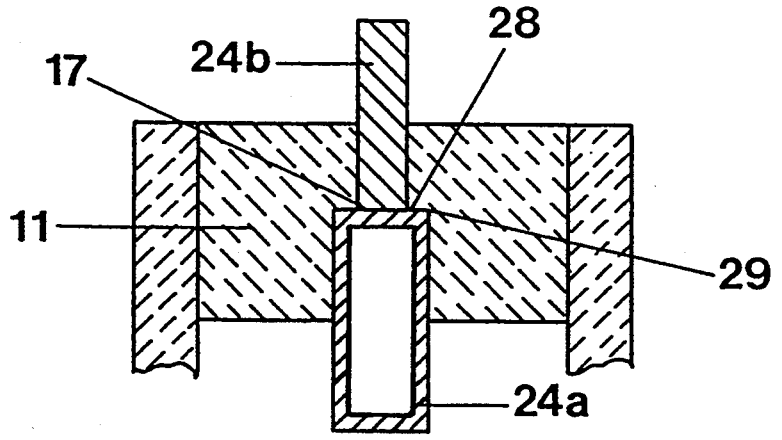

In the case of the one end of the discharge vessel which does not take part in filling of the metal halide component, it is possible to use a simpler structure for the current feedthrough. FIGS. 6 and 7 illustrate such end structures of discharge vessels in which the diameter of the second member is at least 0.4 mm smaller than the diameter of the first member.

In FIG. 6, the current feedthrough consists of a molybdenum tube 24*a* having 2 mm in outside diameter and a niobium rod 24*b* having 1 mm in outside diameter. The molybdenum element terminates at about 40–50% of the height of the plug 11 and is welded to the niobium rod at the seam 17. They are inserted into a plug 11 having its central opening with a recess 28 to provide for the different diameters of the tube members. This example can be so modified as shown in FIG. 7 that the molybdenum tube 25*a* having 1 mm in inner diameter and a wall thickness of 0.2 mm is used instead of the tube 24*a*. The niobium rod 25*b* has essentially the same size as above. It is inserted somewhat into the open end 27 of tube 25*a* facing away from the discharge, and is welded at that end region 27.

Those end structures are particularly suitable for metal halide lamps with extended lifetime. That is, a small gap might form along the interface between the axial hole of the plug and the outside surface of the molybdenum element only after sequences of switching on and off, and, as a result, the agressive fill, which is especially corrosive in the liquid state, penetrates only after a long time into such a gap and reacts with the niobium part. However, in the above cases, the bonding portion of the molybdenum member is surrounded very tightly with the alumina ceramic plug. Especially at the edge 29 of the recess 28 the sealing of the molybdenum member is very good. The reason for this behavior is not yet fully understood but the edge seems to be an essential feature in combination with a molybdenum member, having a greater diameter than the niobium member and being pressed only with the low force correlated to a shrinkage of only 1–3% as mentioned above. Thus, the penetration of agressive fill into the niobium part is reliably prevented, and this results in the manufacture of lamps with long lifetime. Those current feedthroughs can be made simply, safely, and especially cheaply.

Figure 8A:
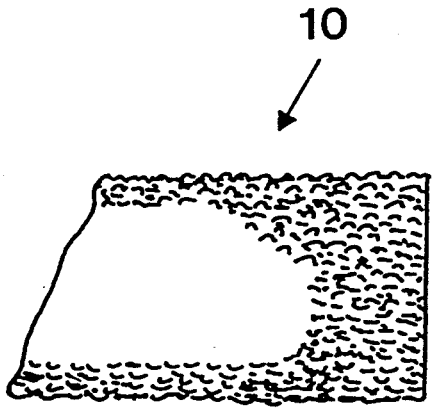

To provide for a good sealing, it is recommended to roughen the outer surface of the current feedthroughs especially in the region of the plug. This applies both to the integral feedthrough 10 and to the composite version. The toughened surface can be of irregular shape (see FIG. 8*a*), for example by means of sandblasting, chemical etching or with the aid of a diamond rasp.

Figure 8B:
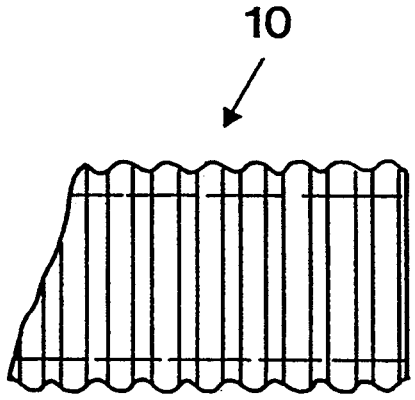
Figure 8C:
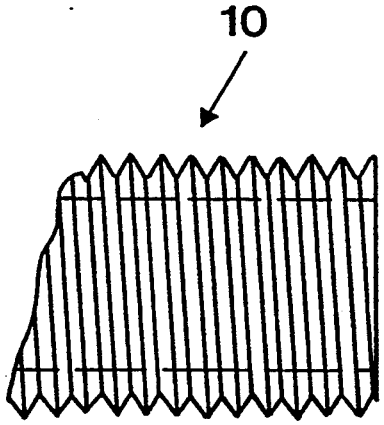

Another possibility is a surface with a regular shape which can be formed by machining. In FIG. 8*b*, respectively 8*c*, a rolling shape, respectively a screw shape is shown.

The direct sealing of the composite current feedthrough into the plug is carried out as follows in all examples:

The present process for producing a discharge vessel of translucent alumina, provided with a plug and a current feedthrough which is directly sealed into the axial hole of the plug at both ends of the vessel, comprises preparing current feedthroughs as illustrated in FIGS. 3 to 7, said feedthroughs being provided with an electrode system and being made by welding a molybdenum member to a niobium member. It comprises further providing two kinds of dispersions composed of alumina and doping material of MgO and/or $Y_2O_3$ as known in the prior art. One of the said dispersions applies for the discharge vessel body; the alumina used for this dispersion has a specific surface area of about 5 to 10 $m^2/g$. The other dispersion applies for the plug body; the alumina used for this dispersion has a specific surface area of about 3 to 5 $m^2/g$.

The dispersions are formed into two kinds of green bodies which have vessel-resp. plug-shape, the difference in linear shrinkage ($\Delta L/Lo(\%)$), which is the difference in length between the green body and the sintered body, $\Delta L$, divided by the length of the green body, Lo, between said two green bodies being preferably about 3 to 5%, for example, said vessel-shape green body having a linear shrinkage of about 21 to 24% and said plug-shape green body having a linear shrinkage of about 17 to 20%. The process for producing a discharge vessel comprises further baking said formed bodies in an air atmosphere at a temperature of about 1000° C. to 1300° C. to eliminate impurities including shaping aids and water, positioning a current feedthrough into the axial hole of said prefired plug body, pre-sintering the said plug body-feedthrough-combination in an atmosphere of argon mixed with 7% of hydrogen at a temperature of about 1250° C. to 1500° C. until both the plug and the feedthrough are partially contacted, inserting the said pre-sintered body into a bonding portion in each end of the said prefired vessel body, and sintering finally the said assembled body in an atmosphere of vacuum of at least $10^{-4}$ tort at a temperature of about 1750° C. to 1900° C. for 3 to 5 hours to produce a sintered discharge vessel with directly sealed-in current feedthroughs, said discharge portion of the body being optically translucent.

The result is a sintered body having a perfect gas-tightness at the interfaces of the vessel to the plug bonding portion and plug to current feedthrough direct sealing portion.

Figure 9:
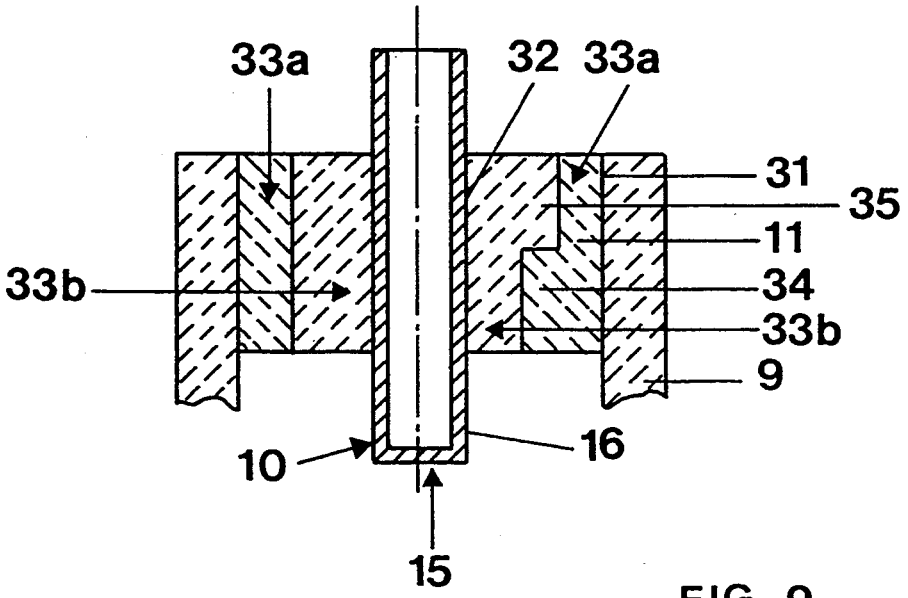

In a further example, shown in FIG. 9, the plug again consists of a composite material, similar to the example mentioned in connection with FIG. 2. Parts that are similar to those of FIG. 2 have the same designation numbers as in FIG. 2. The plug, however, is divided into two concentric cylindrical parts 33*a* and 33*b*. Each part has a different proportion of tungsten (left side of FIG. 9). Whereas the outer part 33*a* comprises 20% by weight of tungsten, the balance being alumina, the inner part 33*b* comprises 28% by weight of tungsten, balance alumina. Thus, a more graded transition of the thermal coefficients of expansion is achieved between the pure alumina of the end of the discharge vessel and the pure metal of the molybdenum tube 10.

In a preferred embodiment (right side of FIG. 9) the outer part has a step 34, on which a nose 35 of the inner part 33*b*rests, so that manufacturing is simplified.

Instead of using plugs built up of two parts it is possible to use plugs of three or even more concentric parts with stepwise graded coefficients of thermal coefficients whereby the difference in coefficients between neighbouring parts is rather small compared with a two part plug.

In a further embodiment the proportion of the tungsten or an other second component of the composite material changes inside of the one body plug resp. inside at least one of the concentric parts of it. The proportion enhances in radially direction from the outer surface to the inner surface whereby a smoother transition of thermal coefficients is achieved. On the other hand, the preparation of the plug takes more care.

Another possibility is the use of a pure plug material, which is not a composite but nevertheless having a lower coefficient of thermal expansion than that of the alumina which is used for the discharge vessel. A preferred material is AlN, having nearly the same thermal coefficient like the metal feedthrough made from molybdenum or tungsten. An alternative is aluminum oxynitride, whose thermal coefficient lies between that of the discharge vessel and that of the feedthrough. For example, the embodiment of FIG. 9 can be modified to use a two part plug, wherein the outer part 33*a* is made from aluminum oxynitride and the inner part 33*b* is made from AlN (aluminum nitride).

Naturally, a two part plug (or any multipart plug) can be made in that way, that at least one part of the plug is made from composite material as mentioned above and at least one part of the plug is made from AlN or aluminum oxynitride.

We claim:

1. High-pressure discharge lamp having a ceramic discharge vessel (8) defining two open ends;

an ionizable fill within the vessel;

two ceramic members, each formed as a plug (11) inserted in a respective open end of the vessel, said plugs being formed with an axial opening therethrough;

a metallic current feedthrough (10) of circular cross-section located in the opening of each plug;

wherein at least a main or first member (16, 16*a*, 18*a*, 25*a*) of the current feedthrough (10) is tubular and has a thermal coefficient of expansion which is smaller than the thermal coefficient of expansion of the ceramic;

wherein the ceramic discharge vessel (8) consists essentially of alumina;

the plug (11) is non-conductive and comprises alumina at least as the main component; and the current feedthrough is gas-tightly sintered into the plug (11) devoid of a ceramic sealing material.

2. High-pressure discharge lamp as in claim 1, characterised in that the current feedthrough (10) or its main or first part (16*a*) consists of molybdenum, tungsten or rhenium or an alloy of these metals.

3. High-pressure discharge lamp as in claim 1, characterised in that the current feedthrough (10) is a unitary member (10) formed as a tube.

4. High-pressure discharge lamp as in claim 1, characterised in that the outer diameter of the current feedthrough tube is about 1.0 to 2.0 mm with a wall thickness of 0.1 to 0.25 mm.

5. High-pressure discharge lamp as in claim 1, characterised in that the surface roughness of the current feedthrough (10) is about 10–50 μm by Ra.

6. High-pressure discharge lamp as in claim 1, characterised in that the current feedthrough is a composite member (16*a*, 16*b*; 18*a*, 18*b*; 24*a*, 24*b*; 25*a*, 25*b*) which comprises, in addition to the main or first tubular member (16*a*; 18*a*; 24*a*; 25*a*) on the side of that first member facing away from the inner space of the discharge vessel, in the region of the plug (11) an auxiliary or second member (16*b*; 18*b*; 24*b*; 25*b*) whose thermal coefficient of expansion corresponds approximately to that of the ceramic.

7. High-pressure discharge lamp as in claim 6, characterised in that the second member (16*b*; 18*b*; 24*b*; 25*b*) consists of niobium or tantalum.

8. High-pressure discharge lamp as in claim 6, characterised in that the second member (16*b*; 18*b*; 24*b*; 25*b*) is gas-tightly welded to the first member (16*a*; 18*a*; 24*a*; 25*a*).

9. High-pressure discharge lamp as in claim 6, characterised in that the second member (16*b*; 18*b*; 24*b*; 25*b*) is so secured to the first member (16*a*; 18*a*; 24*a*; 25*a*) that a distance of the second member from the inner space of the discharge vessel is at least 40% of the height of the plug.

10. High-pressure discharge lamp as in claim 6, characterised in that the second member (16*b*; 18*b*; 24*b*; 25*b*) has a height of at least 30% of the height of the plug.

11. High-pressure discharge lamp as in claim 6, characterised in that the second member (16*b*; 24*b*; 25*b*) is fitted to the first member (16*a*; 24*a*; 25*a*) as its extension, defining a seam (17) between both members.

12. High-pressure discharge lamp as in claim 11, characterised in that both members are formed as tubes (16; 18).

13. High-pressure discharge lamp as in claim 12, characterised in that the second member (16*b*')- and, optionally, also the first member (16*a*)- are closed (21; 21') at the seam (17).

14. High-pressure discharge lamp as in claim 12, characterised in that both members have approximately the same diameter and the same wall thickness.

15. High-pressure discharge lamp as in claim 11, characterised in that the second member is formed as a rod (24*b*; 25*b*).

16. High-pressure discharge lamp as in claim 15, characterised in that the first member (24*a*; 25*a*) has a greater diameter than the second member (24*b*; 25*b*) and the opening in the plug is provided with a recess (28) and an edge (29) at the height of the seam (17) to provide for tight sealing.

17. High-pressure discharge lamp as in 16, characterised in that the second member is a rod (25*b*) which is inserted in the open end (27) of the tubular first member (25*a*).

18. High-pressure discharge lamp as in claim 6, characterised in that the outside diameter of the current feedthrough is about 2.5 mm at maximum.

19. High-pressure discharge lamp as in claim 16, characterised in that the outside diameter of the second member is at least 0.4 mm smaller than that of the first member.

20. High-pressure discharge lamp as in claim 6, characterised in that the second member is formed as a tube and narrowly surrounds a portion of the first member (18*a*) as a collar (18*b*; 18').

21. High-pressure discharge lamp as in claim 20, characterised in that the inner diameter of the second member is about 1.2 to 2.0 mm at a wall thickness of 0.1 to 0.25 mm.

22. High-pressure discharge lamp as in claim 20, characterised in that the second member (18') is disposed sunk within a cylindrical recess (20) in the plug (11) and is covered by a ring (22) of ceramic towards the side facing away from the discharge.

23. High-pressure discharge lamp as in claim 6, characterised in that the surface roughness of the composite current feedthrough in the whole region of the plug is about 10 to 100 μm by Ra.

24. High-pressure discharge lamp as in claim 1, characterised in that the fill includes a halogen containing component.

25. High-pressure discharge lamp as in claim 3, characterised in that at least one plug (11) consists of a composite or pure material having a coefficient of thermal expansion which lies between the coefficients of the vessel ceramic and the current feedthrough.

26. High-pressure discharge lamp as in claim 25, characterised in that the composite material comprises said alumina as said main component and one or more materials as a second component having a lower coefficient of thermal expansion than alumina.

27. High-pressure discharge lamp as in claim 26, characterised in that the second component comprises W, Mo, Re, graphite, AlN, TiC, SiC, ZrC, $TiB_2$, $Si_3N_4$ and $ZrB_2$.

28. High-pressure discharge lamp as in claim 26, characterised in that the alumina is present between 60 to 90% by weight.

29. High-pressure discharge lamp as in claim 25, characterised in that the plug is made from at least two concentric parts (33*a*, *b*) with graded coefficients of thermal expansion.

* * * * *